US005792241A

United States Patent [19]

Browitt

[11] Patent Number: 5,792,241

[45] Date of Patent: Aug. 11, 1998

[54] PRECIPITATOR

[75] Inventor: Rodney Browitt, Kaleen, Australia

[73] Assignees: Allrad No. 28 Pty Ltd.; Allrad No. 29 Pty Ltd.; Allrad No. 19 Pty Ltd., all of Canberra, Australia

[21] Appl. No.: 530,983

[22] Filed: Sep. 20, 1995

[30] Foreign Application Priority Data

Sep. 21, 1994 [AU] Australia ..... PM8332
Jun. 2, 1995 [AU] Australia ..... PN3332

[51] Int. Cl.[6] ..... B03C 3/16

[52] U.S. Cl. ..... 96/52; 96/61; 96/74; 96/97; 261/81; 261/DIG. 48

[58] Field of Search ..... 96/27, 52, 53, 96/74, 61, 69, 44, 45, 97; 95/64–66, 71, 72, 78, 59, 75; 261/81, DIG. 48

[56] References Cited

U.S. PATENT DOCUMENTS

| | | | |
|---|---|---|---|
| 2,597,201 | 5/1952 | Swiss et al. | 252/88.2 |
| 3,643,623 | 2/1972 | Eng et al. | 96/27 X |
| 4,146,371 | 3/1979 | Melcher et al. | 96/53 X |
| 4,388,089 | 6/1983 | Reif et al. | 96/45 |
| 4,846,856 | 7/1989 | Burger et al. | 96/53 X |
| 5,064,634 | 11/1991 | Burch | 128/659 X |
| 5,137,546 | 8/1992 | Steinbacher et al. | 96/52 X |

FOREIGN PATENT DOCUMENTS

| | | |
|---|---|---|
| 392 741 | 5/1991 | Austria . |
| 717239 | 6/1968 | Belgium . |
| 3600137 | 7/1987 | Germany . |
| 362682 | 8/1962 | Switzerland . |
| 516158 | 12/1939 | United Kingdom . |

OTHER PUBLICATIONS

Inculet, I.I., et al., (1989) "Electrostatic Dissipation of Smoke Using Evaporation Charged Water Spray", Conference Record of the Industry Applications Society Annual Meeting (IAS), San Diego, Oct. 1–5, 1989, Part 2:2144–2147.

*Primary Examiner*—Richard L. Chiesa
*Attorney, Agent, or Firm*—Townsend and Townsend and Crew LLP

[57] ABSTRACT

An electrostatic precipitator including a cylindrical tube the upper end of which is provided with a gas outlet while the lower end is provided with a gas inlet. Mounted adjacent the upper end of the tube is an ion source. Adjacent the lower end of the tube is a diaphragm which is vibrated by an ultrasonic transducer. A liquid is supported on the diaphragm and caused to vibrate in order to produce a mist. An electric potential is established between the ion source and the liquid so that carbon particles contained in the gas stream passing through the precipitator are trapped by liquid droplets which are then conveyed back to a reservoir for the liquid.

9 Claims, 4 Drawing Sheets

PRECIPITATOR

TECHNICAL FIELD

The present invention relates to electrostatic precipitators.

BACKGROUND OF THE INVENTION

Described in U.S. Pat. No. 5,064,634 is a method and apparatus for producing an inhalable radionuclide. In particular there is described a carbon crucible heated to a temperature within the range of 1500° C. to 2500° C. The carbon crucible under such a temeprature produces carbon particles of the size about 10 nm. Ordinary methods of incorporating these particles into solution by bubbling are unsatisfactory. A further problem associated with their collection is their radioactive nature. Any collection system needs to shield against operator exposure.

OBJECT OF THE INVENTION

It is the object of the present invention to overcome or substantially ameliorate the above disadvantages.

SUMMARY OF THE INVENTION

There is disclosed herein an electrostatic precipitator, said precipitator comprising:

a housing defining a duct through which a gas containing carbon particles passes, said duct having an inlet and an outlet;

an ion source past which the gas passes the charge the particles;

an electrode between said inlet and said outlet and spaced downstream from said ion source;

means to establish an electric potential between said ion source and said electrode; and wherein said electrode is coated with a soluble material to which the particles are attracted so as to become deposited thereon.

There is further disclosed herein an electrode for an electrostatic precipitator, said electrode including a coating of a soluble material upon which the particles are deposited by being attracted thereto.

There is still further disclosed herein an electrostatic precipitator to collect particles from a gas stream, said precipitator comprising:

a duct through which the gas passes between an inlet and an outlet;

an ion source between said inlet and said outlet and past which said gas passes to have the particles charged;

a reservoir containing a liquid past which the gas passes; and means to establish an electric potential between said ion source and said reservoir so that particles are attracted to said liquid.

There is further disclosed herein an electrostatic precipitator, said precipitator comprising:

a housing defining a duct through which a gas containing carbon particles passes, said duct having an inlet and an outlet;

an ion source projecting into said duct and located between said inlet and said outlet;

a wall surrounding at least part of said duct between said inlet and said outlet;

means in said duct to receive a liquid;

means to enable the establishment of an electric potential between said ion source and said liquid;

means to cause said liquid to produce droplets to be dispersed in said duct; and wherein upon the application of said electric potential, said droplets and particles are attracted to said wall.

There is also disclosed herein a method of collecting carbon particles, said method including the steps of:

passing a gas stream containing the particles, through a chamber, the gas stream including an inert gas and air;

passing the gas stream past an ion source within the chamber to charge the particles;

attracting the particles to an electrode by establishing an electrical potential between said ion source and said electrode.

BRIEF DESCRIPTION OF THE DRAWINGS

Preferred forms of the present invention will now be described by way of example with reference to the accompanying drawings wherein.

DETAILED DESCRIPTION OF THE PREFERRED EMBODIMENTS

Figure 2:
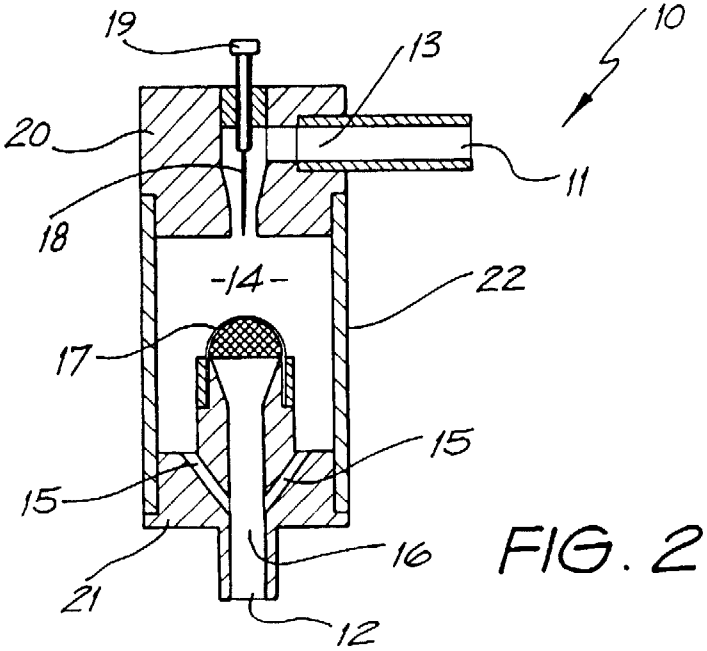
FIG. 2 is a schematic sectioned front elevation of the precipitator of FIG. 1.
Figure 3:
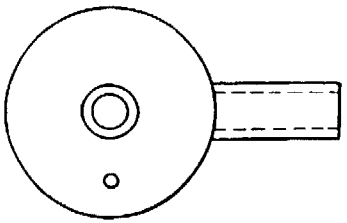
FIG. 3 is a schematic top plan view of the precipitator of FIGS. 1 and 2.
Figure 1:
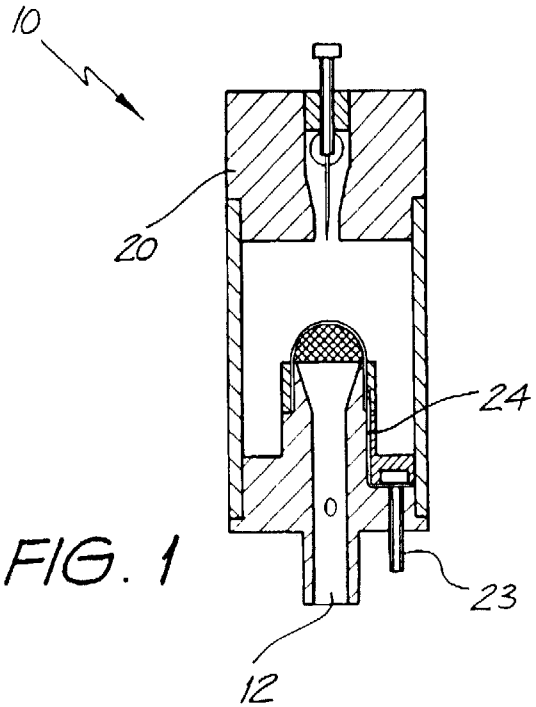
FIG. 1 is a schematic sectioned side elevation of an electrostatic precipitator.
Figure 5:
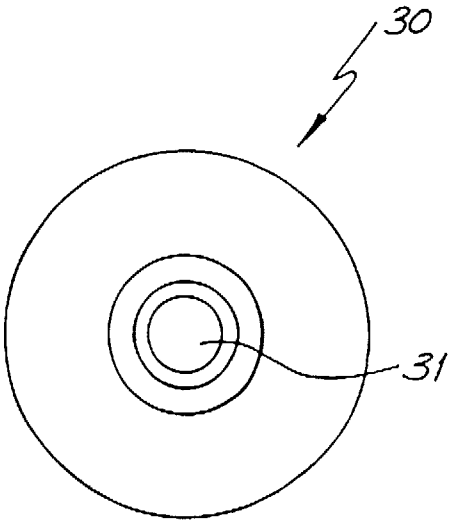
FIG. 5 is a schematic end elevation of the Venturi of FIG. 4.
Figure 4:
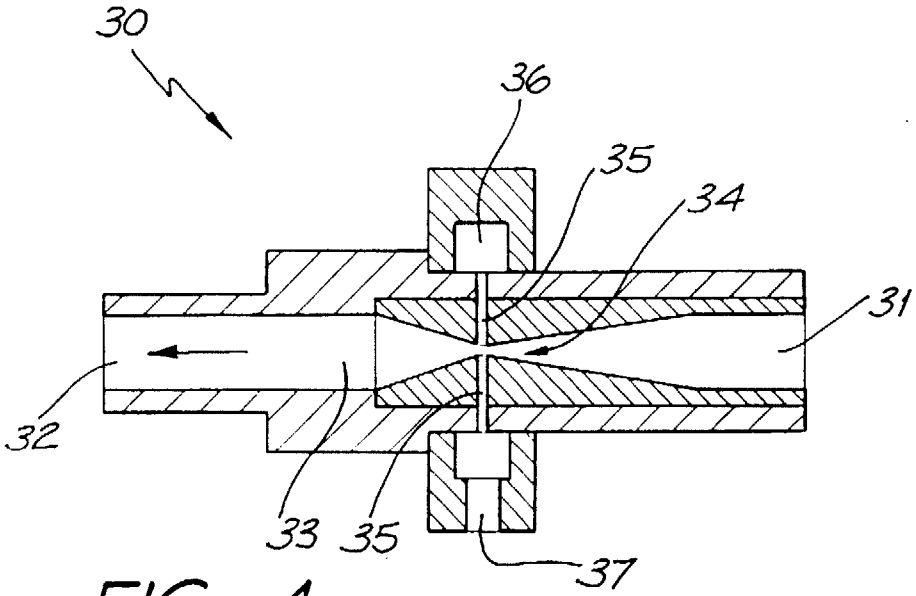
FIG. 4 is a schematic sectioned side elevation of a Venturi to be employed with the precipitator of FIG. 1.

In FIGS. 1 to 3 of the accompanying drawings there is schematically depicted an electrostatic precipitator 10. The precipitator 10 collects carbon particles from a gas stream passing through the precipitator from an inlet 11 to an outlet 12. The precipitator 10 would have a field strength of 7 kV and would operate at a current about 10 m A.

Gas via the inlet 11 passes along a duct 13 to a chamber 14 wherefrom the gas exits via lateral passages 15 extending to a central passage 16 terminating with the outlet 12.

Located in the chamber 14 is a collecting electrode 17 which is formed of a stainless steel mesh (316 type steel) coated with glucose or sucrose which also act as surfactants. Soluble salts may also be employed. In essence it should be appreciated that the electrode need only be coated with a substance which would act as a "carrier" in respect of the carbon particles and which could be removed from the electrode 17 so as to take with it the carbon particles.

The duct 13 leads past an ion source 18 mounted by means of an adjustment screw 19.

The precipitator 10 has a body construction consisting of TEFLON (which is tetrafluoroethene) base 20 and a TEFLON cap 21. Joining the base 20 and cap 21 is an acrylic sleeve 22. The adjustment screw 19 provides one terminal, while the other terminal is provided by the screw 23. The screw 23 is joined to the mesh electrode 17 by means of a conductive strip or wire 24.

Typically, the carbon particles produced by heating the carbon crucible containing the volatile radionuclide would be carried by argon gas. However this is an unsatisfactory carrier for the particular precipitator. To address this problem, a Venturi 30 is provided. The Venturi 30 has an inlet 31 and an outlet 32. The passage 33 extending between the inlet 31 and outlet 32 has a restricted portion 34 to which there extend passages 35 from a manifold 36. Extending from the manifold 36 is an air inlet 37. Accordingly, via the outlet 32, a mixture of air and argon exits, containing the carbon particles. The outlet 32 is connected to the inlet 11 of the electrostatic precipitator 10. Preferably the Venture 30 would be formed of TEFLON.

Figure 7:
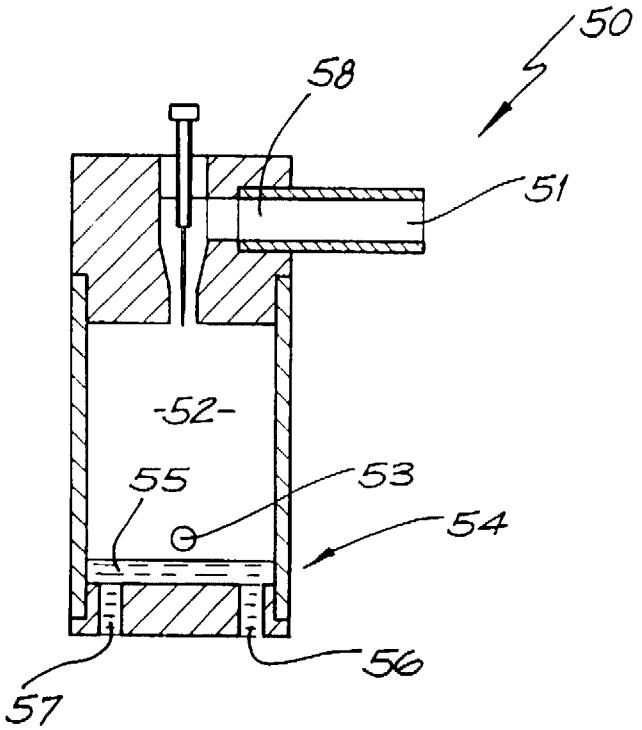
FIG. 7 is a schematic sectioned front elevation of the precipitator of FIG. 6.
Figure 6:
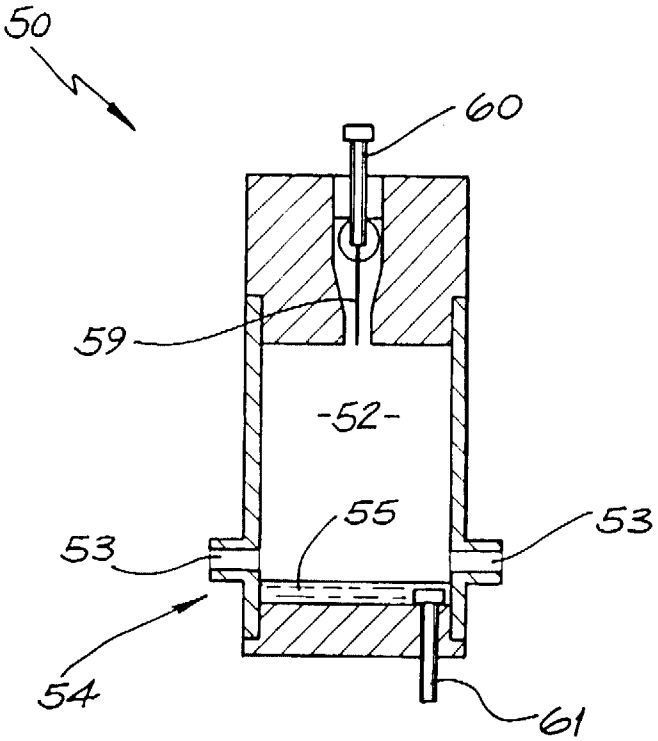
FIG. 6 is a schematic sectioned side elevation of a further electrostatic precipitator.

In FIGS. 6 and 7 there is schematically depicted a precipitator 50. In this embodiment, the precipitator 50 has an inlet 51 extending to a chamber 52 from which ther extend one or more outlets 53. The lower end of the chamber 52 terminates with a reservoir 54 which receives a saline solution 55 containing a trace of glycerin to act as a surfactant. the reservoir 54 is provided with an inlet 56 and an outlet 57 so that the saline solution 55 may be renewed or, alternatively, the precipitator 50 could be arranged so that there is a steady stream through the reservoir 55.

The inlet 55 communicates with a duct 58 which extends past an ion source 59 which is mounted via an adjustment screw 60 which provides one of the terminals. The other terminal 61 charges the saline solution 55 so that the carbon particles delivered to the chamber 52 are attracted to the saline solution 55.

As discussed previously, the carbon particles would be contained in a gaseous mixture of argon and air.

Figure 8:
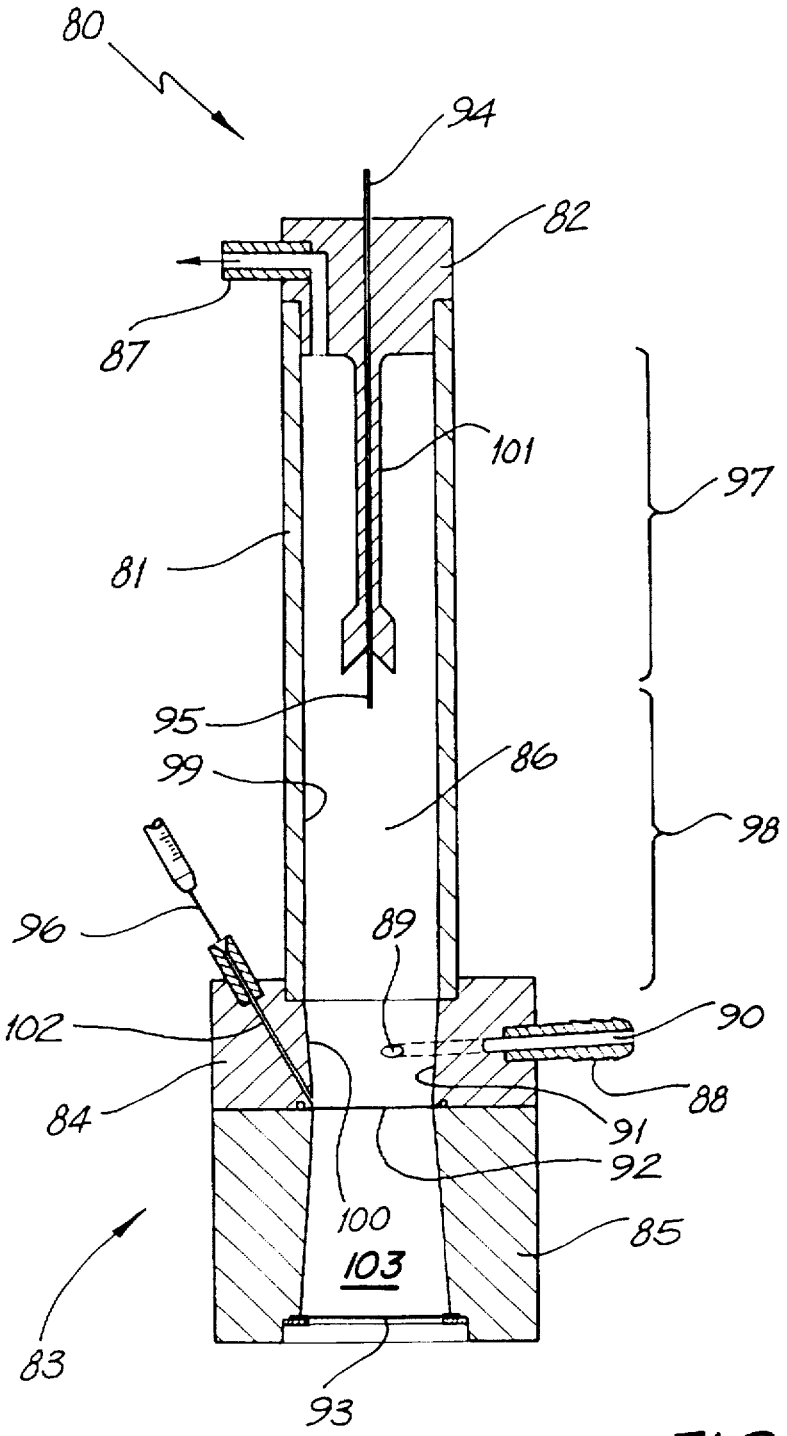
FIG. 8 is a schematic sectioned side elevation of a further precipitator.

In FIG. 8 there is schematically depicted an electronic precipitator 80. The precipitator 80 includes a generally cylindrical tube 81 closed at its upper end by an end cap 82. The lower end of the tube 81 is mounted in a base assembly 83 including an upper part 84, and a lower part 85. The tube 81 and upper part 84 cooperate to define a duct 86, with the cap 82 providing a gas outlet 87, and the upper part 84 providing a gas inlet 88. The gas inlet 88 terminates at the duct 86 with an opening 89. The opening 89 and passage 90 extending therefrom extend substantially at a "tangent" to the cylindrical (or frusto-conical) wall 91, so that gas entering the duct 86 swirls about the longitudinal axis of the tube 81.

The cap 82 is formed of an insulating material such as TEFLON as is the upper part 84. The lower part 85 can be formed of stainless steel. Sandwiched between the upper part 84 and lower part 85 is a diaphragm 92 which may be formed of MYLAR, which is a polyester film.

Mounted in the lower part 85 is an ultrasonic transducer and gas assembly 93.

The cap 82 is formed integral with a stem 101. An ion source in the form of a needle 94 extends through the cap 82 and stem 101 to exit at the lower end thereof. The ion source needle 94 has a lower extremity 95.

Extending through the upper part 84 is a passage 95 through which there can extend or enter a needle 96 of a hypodermic syringe.

The precipitator 80 has a hydrophobic section 97 and a hydrophilic section 98.

In operation of the above described precipitator 80, the cavity 103 between the diaphragm 92 and transducer and gas assembly 93 is filled with water and a trace of a surfactant, for example glycerin.

Initially, water would be delivered to the upper surface of the diaphragm 92 via a hypodermic syringe or other means. Thereafter, the ultrasonic transducer 93 would be activated to cause the diaphragm 92 to vibrate. Typically the transducer would be an ultrasonic crystal oscillating at approximately 1.7 MHz. The water on the diaphragm 92 would be energized to form a dense stream of "mist" (small water droplets). The water delivered to the diaphragm 93 would preferably be saline, or other ionic chemical, in order to provide the free ions necessary for the water or other ionic chemical to be conductive.

An electric potential is applied between the extremity 95 (corona point) and the liquid delivered to the diaphragm 92. This can be done via the needle 96. The ultrasonic transducer in creating the above discussed mist causes a "washing down" of the interior wall 99 of the tube 81 surrounding the section 98. The water also runs down the internal wall 100 of the upper part 84. The water on the diaphragm 92, and the wetted walls 99 and 100, form the electrostatic collection electrode.

Particles in the gas which become ionized are therefore attracted to the water droplets and walls, while the water droplets themselves become ionized and are also attracted to the walls 99 and 100. In this regard it should be appreciated that an electric potential is applied to the needles 94 and 96, more particularly a positive 8 kv charge is applied to the needle 95, at about 100 micro amp maximum current.

The ultrasonic transducer is controlled to ensure that the mist does not rise to an extent that it will cause a short circuit to the extremity 95.

The hypodermic syringe having the needle 96 is inserted in the upper part 84 to make electrical contact with the liquid on the upper part of the diaphragm 92, thereby making a return ground potential and also providing a means of introducing liquid to the interior of the precipitator 80. The needle 96 may also be used to remove liquid containing the carbon particles.

In the above described precipitator 80, other liquids apart from water could be used. For example the liquid could be an oil-based liquid.

What is claimed is:

1. An electrostatic precipitator comprising:

a housing defining a generally upwardly extending duct through which a gas containing carbon particles passes, said duct having a lower inlet for said gas and an upper outlet for said gas;

an ion source projecting into said duct and located between said inlet and said outlet;

a wall surrounding at least part of said duct between said inlet and said outlet;

a generally horizontally oriented diaphragm extending across a lower extremity of said duct and to which a liquid is to be delivered;

a vibrator operatively positioned with respect to said diaphragm to cause vibration thereof so that liquid on said diaphragm is caused to form a mist upon the vibration of said diaphragm; and means enabling the establishment of an electric potential between said ion source and said liquid, so that upon the application of said electric potential, said droplets and particles are attracted to said wall.

2. The electrostatic precipitator of claim 1, wherein said vibrator is an ultrasonic transducer.

3. The electrostatic precipitator of claim 2, further including means to deliver and withdraw the liquid from within said duct.

4. The electrostatic precipitator of claim 3, wherein said wall includes an upper hydrophobic portion and a lower hydrophilic portion.

5. The electrostatic precipitator of claim 4, wherein said ion source is a needle projecting into said duct and has a lower extremity located at a position spaced above said diaphragm.

6. The electrostatic precipitator of claim 5, wherein the means to deliver and withdraw the liquid from within said duct is used to establish said electric potential.

7. The electrostatic precipitator of claim 6, wherein the means to deliver and withdraw said liquid is a hypodermic syringe with the means to establish the electric potential being positioned with respect to the syringe, so that the electric potential exists between the ion source and the liquid ejected from the syringe.

8. An electrostatic precipitator comprising:

a housing defining a vertical longitudinal axis and defining an upwardly extending duct through which a gas containing carbon particles passes, the housing including a gas outlet at an upper portion of said duct and a gas inlet at a lower portion of said duct, the inlet extending at least partially tengential with respect to said duct to cause said gas to move angularly about said axis;

an ion source comprising a needle projecting into the duct and being located between the inlet and the outlet;

a wall surrounding at least part of said duct between said inlet and said outlet, said wall including an upper hydrophobic portion and a lower hydrophilic portion;

a substantially horizontally extending diaphragm in said duct, the diaphragm being adjacent said inlet and being configured to receive a body of liquid;

means to enable the establishment of an electric potential between said ion source and said body of liquid; and an ultrasonic transducer to vibrate said diaphragm to cause said body of liquid to produce droplets to be dispersed in said duct;

wherein upon the application of said electric potential, said droplets and particles are attracted to said wall.

9. The precipitator of claim 8, further including means to deliver and withdraw the liquid from said liquid receiving means.

* * * * *